US010427818B2

(12) United States Patent
Miyashita

(10) Patent No.: US 10,427,818 B2
(45) Date of Patent: Oct. 1, 2019

(54) STRAPPING APPARATUS, STRAPPING METHOD AND PAPER SHEETS PROCESSING APPARATUS

(71) Applicant: Kabushiki Kaisha Toshiba, Tokyo (JP)

(72) Inventor: Morimasa Miyashita, Kanagawa (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 494 days.

(21) Appl. No.: 15/233,194

(22) Filed: Aug. 10, 2016

(65) Prior Publication Data

US 2017/0259950 A1 Sep. 14, 2017

(30) Foreign Application Priority Data

Mar. 11, 2016 (JP) ..... 2016-048514

(51) Int. Cl.
*B65B 13/02* (2006.01)
*B65B 13/18* (2006.01)
(Continued)

(52) U.S. Cl.
CPC ..... *B65B 57/18* (2013.01); *B65B 13/02* (2013.01); *B65B 13/16* (2013.01); *B65B 13/18* (2013.01);
(Continued)

(58) Field of Classification Search
CPC ..... B65B 13/02; B65B 13/022; B65B 13/16; B65B 13/18; B65B 27/00; B65B 27/08;
(Continued)

(56) References Cited

U.S. PATENT DOCUMENTS 4,110,826 A * 8/1978 Mollgaard ..... H04N 1/54 382/165
4,374,463 A * 2/1983 Omura ..... G07D 7/12 53/54
(Continued)

FOREIGN PATENT DOCUMENTS

| | | |
|---|---|---|
| JP | 2686068 B2 | 8/1997 |
| JP | 2004-238017 A | 8/2004 |
| WO | 2009066297 A2 | 5/2009 |

OTHER PUBLICATIONS

Office Action issued in related EP Application No. 16183335.5, dated Aug. 16, 2017 (8 pages).

*Primary Examiner* — Shelley M Self
*Assistant Examiner* — Katie L. Parr
(74) *Attorney, Agent, or Firm* — Baker Botts L.L.P.

(57) ABSTRACT

According to one embodiment, a strapping apparatus includes a setting device, a determination device, a strap band supply device, an acquisition device, a color decision device, and a warning presentation device. The setting device sets a denomination of paper sheets to be strapped. The determination device determines a color of a strap band to strap a bundle of the paper sheets, based on the denomination. The strap band supply device supplies strap bands from a first strap band reel previously stored. The acquisition device acquires an image of the first strap band reel. The color decision device decides a color of the first strap band reel, based on the image. The warning presentation device presents a warning if the color of the first strap band reel is different from the color determined by the determination device.

17 Claims, 7 Drawing Sheets

(51) Int. Cl.

| | |
|---|---|
| ***B65B 27/08*** | (2006.01) |
| ***B65B 35/50*** | (2006.01) |
| ***B65B 57/04*** | (2006.01) |
| ***B65B 57/18*** | (2006.01) |
| ***B65B 13/16*** | (2006.01) |
| ***B65B 41/12*** | (2006.01) |
| ***B65B 57/08*** | (2006.01) |
| ***B65B 59/00*** | (2006.01) |
| ***B65B 59/02*** | (2006.01) |
| ***G07D 11/235*** | (2019.01) |
| ***G07D 11/50*** | (2019.01) |
| *B65B 57/20* | (2006.01) |

(52) U.S. Cl.
CPC ..... *B65B 27/08* (2013.01); *B65B 35/50* (2013.01); *B65B 41/12* (2013.01); *B65B 57/04* (2013.01); *B65B 57/08* (2013.01); *B65B 59/00* (2013.01); *B65B 59/02* (2013.01); *G07D 11/235* (2019.01); *G07D 11/50* (2019.01); *B65B 57/20* (2013.01); *B65B 2210/04* (2013.01)

(58) Field of Classification Search
CPC ..... B65B 35/00; B65B 35/50; B65B 41/12; B65B 57/04; B65B 57/08; B65B 57/18; B65B 57/20; B65B 59/00; B65B 59/02; B65B 2210/02; B65B 2210/04; G07D 11/0048; G07D 11/0084; B07C 15/00; B07C 1/02; G06K 9/4652; G06T 7/90
USPC ..... 100/4; 328/135
See application file for complete search history.

(56) References Cited

U.S. PATENT DOCUMENTS

| | | | | |
|---|---|---|---|---|
| 7,604,425 | B2 * | 10/2009 | Otsuka | B65B 27/08 194/206 |
| 2004/0003980 | A1 * | 1/2004 | Hallowell | B65B 27/08 194/206 |
| 2005/0241270 | A1 * | 11/2005 | Katsumata | B65B 13/22 53/64 |
| 2008/0149657 | A1 * | 6/2008 | Kim | G07F 11/00 221/2 |
| 2009/0248199 | A1 * | 10/2009 | Milhorn | B01F 13/1055 700/239 |
| 2010/0326789 | A1 * | 12/2010 | Yokota | B65B 27/08 194/206 |
| 2011/0125313 | A1 * | 5/2011 | Hodatsu | G07D 11/0084 700/223 |
| 2012/0078410 | A1 * | 3/2012 | Wong | G06Q 10/06395 700/110 |
| 2014/0150383 | A1 * | 6/2014 | Okamoto | B65B 27/08 53/589 |
| 2017/0057682 | A1 * | 3/2017 | Chudy | B65B 11/52 |
| 2018/0342126 | A1 * | 11/2018 | Stapfer | G07D 11/50 |

* cited by examiner

| BANKNOTE | THE NUMBER OF SHEETS | COLOR |
|---|---|---|
| $1 | 50 | PINK |
| | 100 | BLUE |
| $2 | 50 | GREEN |
| | 100 | RED |
| $5 | 50 | YELLOW |
| | 100 | PURPLE |
| $10 | 50 | BROWN |
| | 100 | BLACK |
| $20 | 50 | GRAY |
| | 100 | ORANGE |
| $50 | 50 | INDIGO |
| | 100 | LIGHT BLUE |
| $100 | 50 | BLUISH PURPLE |
| | 100 | MUSTARD |

STRAPPING APPARATUS, STRAPPING METHOD AND PAPER SHEETS PROCESSING APPARATUS

CROSS-REFERENCE TO RELATED APPLICATION

This application is based upon and claims the benefit of priority from Japanese Patent Application No. 2016-048514, filed on Mar. 11, 2016; the entire contents of which are incorporated herein by reference.

FIELD

Embodiments described herein relate generally to a strapping apparatus, a strapping method and a paper sheets processing apparatus.

BACKGROUND

In conventional strapping apparatus, paper sheets such as banknotes are bundled by the predetermined number of sheets and strapped by a strap band. An operator previously loads the strap band having a color corresponding to paper sheets (as a strapping target) into the strapping apparatus. The strapping apparatus straps the paper sheets by using the strap band (having the color corresponding to the strapping target) loaded by the operator.

However, in the strapping apparatus, if a strap band having an erroneous color is loaded, the paper sheets are strapped by using the strap band having the erroneous color (as it is), which is a problem.

DETAILED DESCRIPTION

According to one embodiment, a strapping apparatus includes a setting device, a determination device, a strap band supply device, an acquisition device, a color decision device, and a warning presentation device. The setting device sets a denomination of paper sheets to be strapped. The determination device determines a color of a strap band to strap a bundle of the paper sheets, based on the denomination. The strap band supply device supplies strap bands from a first strap band reel previously stored. The acquisition device acquires an image of the first strap band reel. The color decision device decides a color of the first strap band reel, based on the image. The warning presentation device presents a warning if the color of the first strap band reel is different from the color determined by the determination device.

Figure 1:
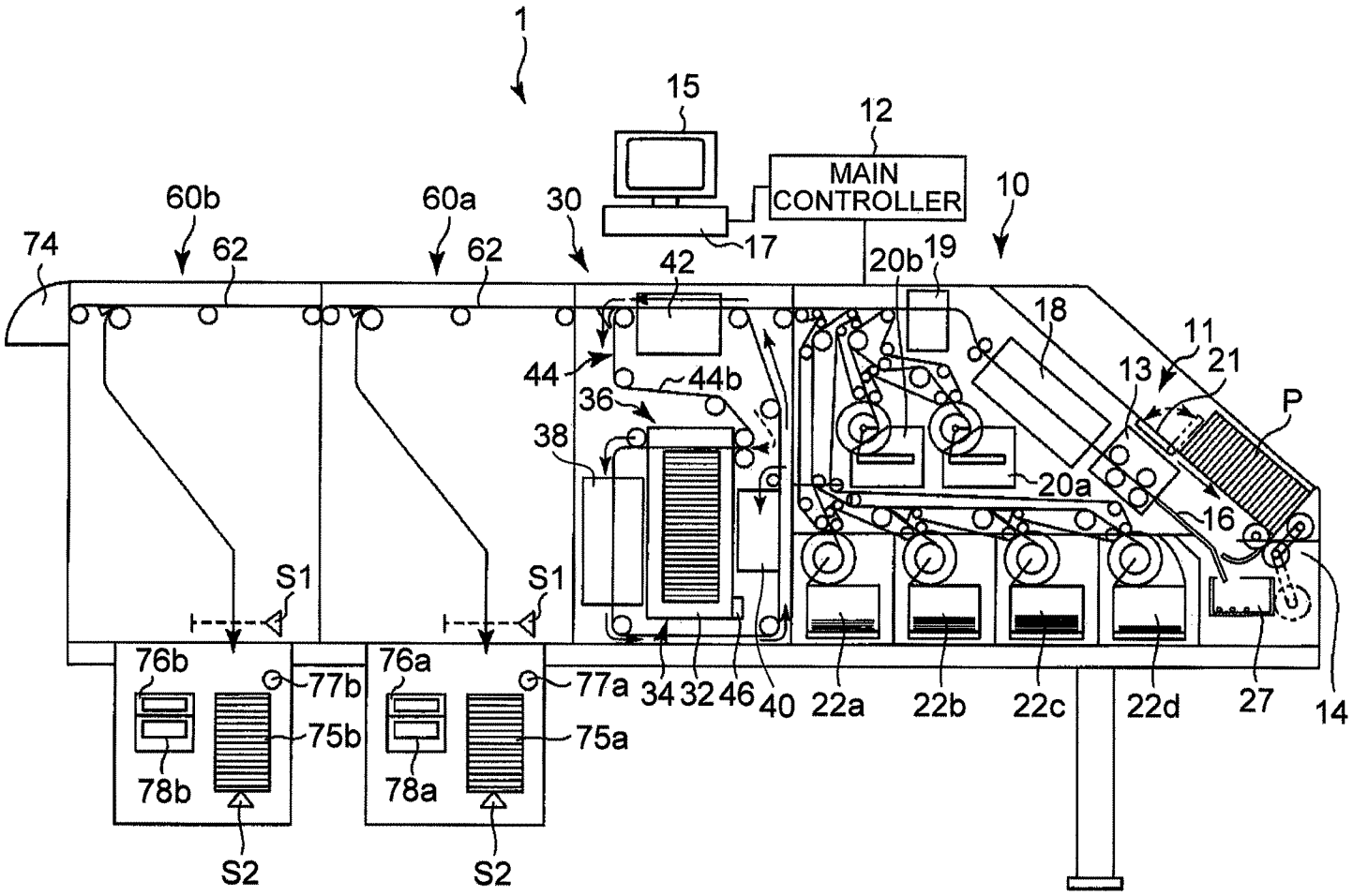
FIG. 1 is one example of general configuration of a paper sheets processing apparatus according to one embodiment.
Figure 2:
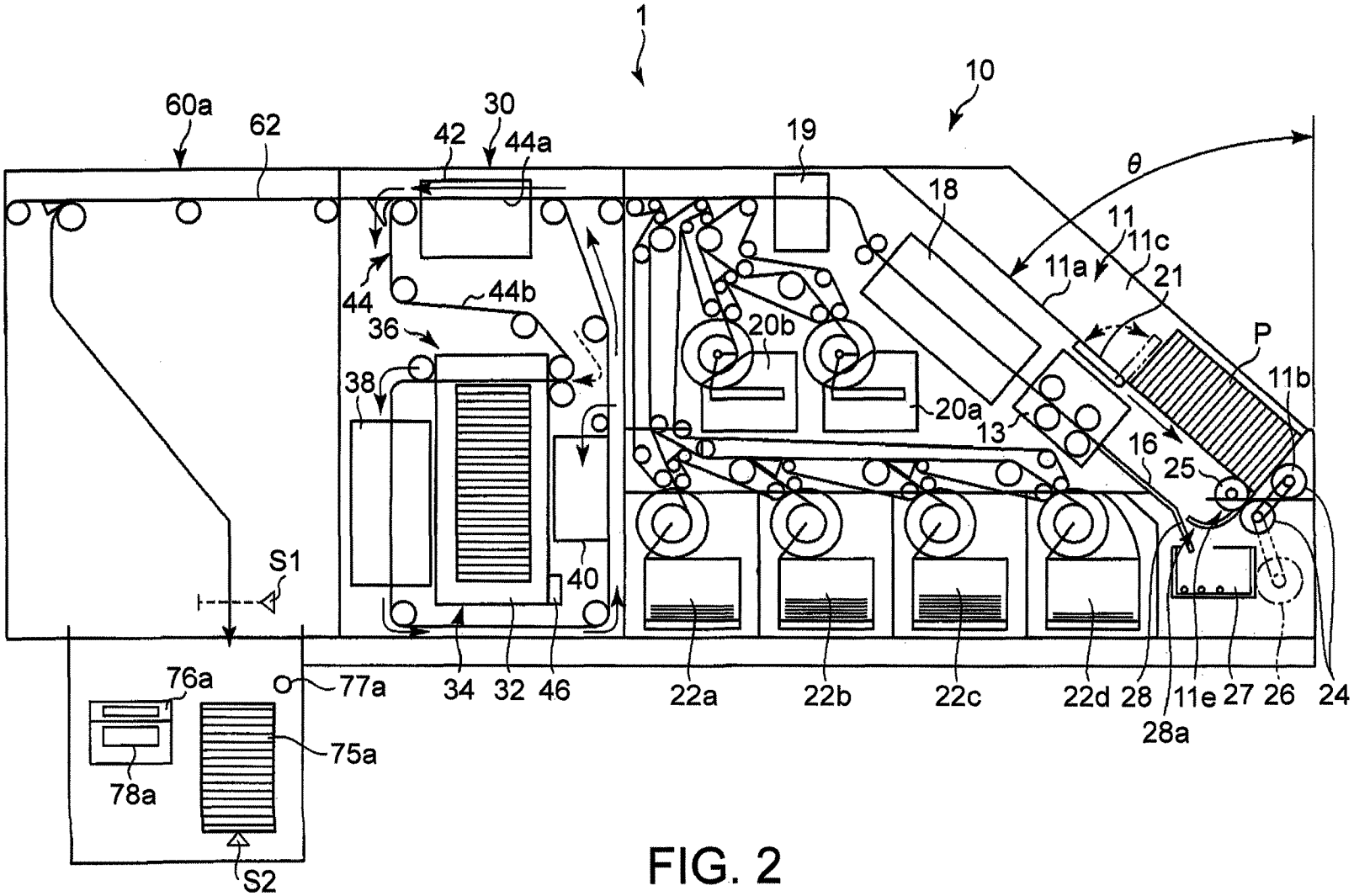
FIG. 2 is an enlarged sectional plan of the paper sheets processing apparatus including a main module, a storage module and a strapping module according to one embodiment.
Figure 3:
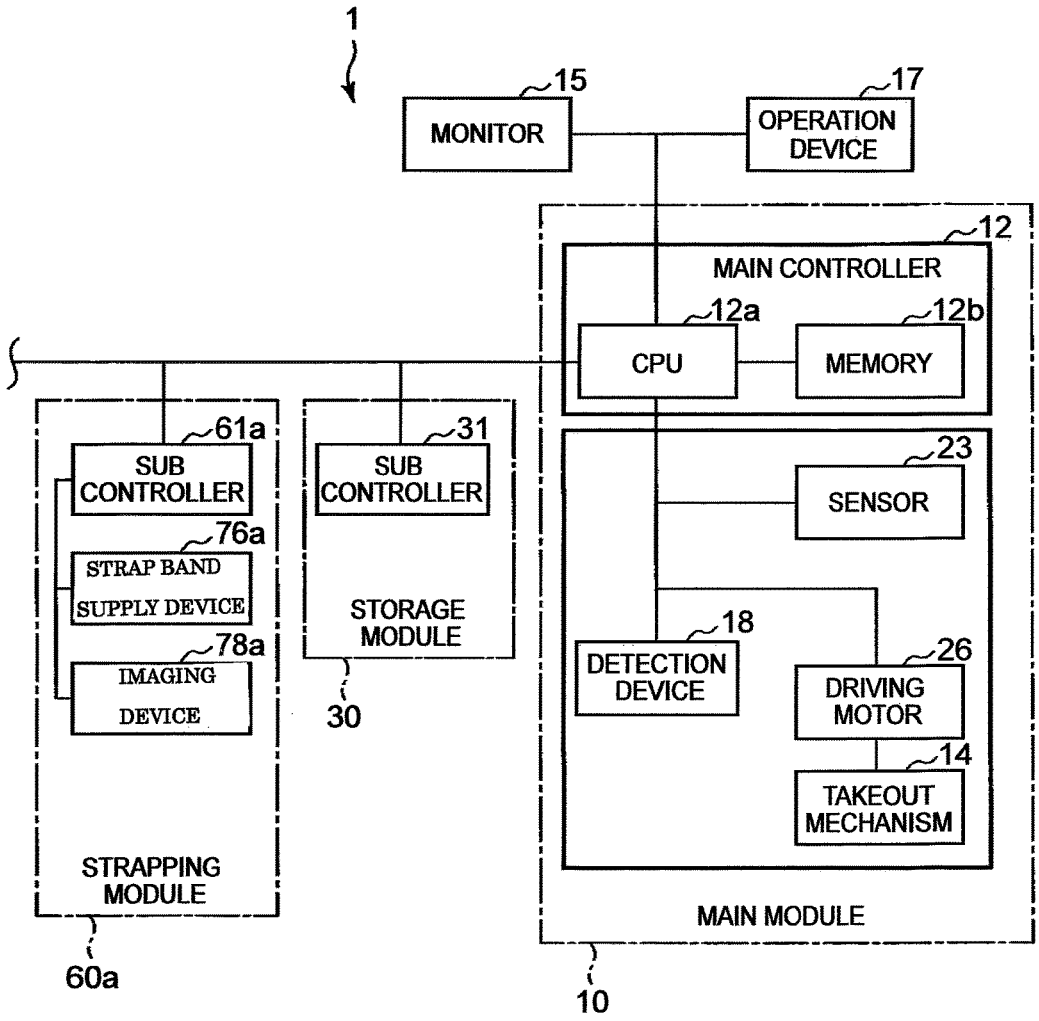
FIG. 3 is a block diagram to explain a control system of the paper sheets processing apparatus according to one embodiment.

Hereinafter, one embodiment will be explained by referring to Figures. FIG. 1 is one example of general configuration of a paper sheets processing apparatus (including a strapping apparatus) according to one embodiment. FIG. 2 is an enlarged sectional plan of the paper sheets processing apparatus 1 including a main module, a storage module and a strapping module. FIG. 3 is a block diagram to explain a control system of the paper sheets processing apparatus 1 according to one embodiment.

As shown in FIG. 1, the paper sheets processing apparatus 1 to process paper sheets includes a main module 10, a storage module 30, a strapping module 60*a* and a strapping module 60*b*. The main module 10, the storage module 30, the strapping module 60*a* and the strapping module 60*b* are aligned in one line orderly and are mutual-connected electrically and mechanically. In the main module 10, a main controller 12 to control operation of the main module 10 and the paper sheets processing apparatus 1 is prepared.

For example, the main controller 12 is prepared on a control board inside the main module 10. As shown in FIG. 3, the main controller 12 includes a CPU 12*a* to control operation of each module and calculate an efficiency of the operation status, and a memory 12*b* to store various data, control programs and management information. The memory 12*b* stores a strap band color table. The strap band table will be explained afterwards.

As to the main controller 12, an operation device 17 to input various information and a monitor 15 to display input information and the operation status (or processing status) are connected. The storage module 30 includes a sub controller 31 to control the operation. The strapping module 60*a* and the strapping module 60*b* include a sub controller 61*a* and a sub controller 61*b* respectively. The sub controller 31, the sub controller 61*a* and the sub controller 61*b* are communicatively connected to the main controller 12 of the main module 10 via an interface and a cable (not shown in Fig.). The main controller 12 is connected to a host computer (not shown in Fig.) and transmits/receives data with the host computer.

The operation device 17 accepts an input of operation from the operator. For example, by the operator's operation, the operation device 17 inputs setting of various operations of the processing apparatus, i.e., setting of transaction method (such as deposit of money and processing service), storing processing into a storage, detection processing of paper sheets in the storage, setting of the storage to store processed paper sheets P, setting of strap band processing, or setting a fitness level as a decision level of paper sheets.

As shown in FIGS. 1 and 2, the main module 10 includes a supply device 11, a takeout mechanism 14, and a transport path 16. In the supply device 11, a large number of paper sheets P is carried with lamination status. The takeout mechanism 14 takes out the paper sheets P one by one from the supply device 11. The transport path 16 transports the paper sheets P taken out by the takeout mechanism 14. On the transport path 16, a plurality of endless transport belts (not shown in Figs.) is extended so as to cramp the transport path. The paper sheets P (taken out by the takeout mechanism) are held by the transport belt and transported. Here, the paper sheets P are banknotes.

As shown in FIG. 2, the supply device 11 includes a support face 11*a*, a carrying face 11*b*, and a pair of guide walls 11*c*. The support face 11*a* is extended with slope of a predetermined angle θ from the vertical direction. The carrying face 11*b* is extended from the lower edge of the support face 11*a* along a direction approximately perpendicular to the support face 11*a*. The pair of guide walls 11*c* is stood along both side edges of the support face 11*a* and the carrying face 11*b*.

At a boundary part between the support face 11*a* and the carrying face 11*b*, a takeout pocket 11*e* to capture the paper sheets P into the apparatus is formed. The supply device 11 is prepared at one side edge of a main body of the main module 10. The carrying face 11*b* is positioned adjacent to the lower edge of the main body.

In the supply device 11, a plurality of paper sheets P (For example, larger than or equal to two thousands sheets) can be carried with lamination status. Among the paper sheets P, a paper sheet of the lowest part is carried on the carrying face 11*b*. For example, under the condition that an edge of long side of the paper sheets is carried on the support face 11*a*, the paper sheets P are loaded into the supply device 11 with slope along the support face 11*a*. By the takeout mechanism 14, the paper sheets P are captured into the apparatus via the takeout pocket 11*e* one by one, in order from a paper sheet of the lowest part.

A slope angle θ of the support face 11*a* is set within a range 25°~75° (For example, 30°~40°). Here, the support face 11*a* may be composed rotationally for the main body so as to adjust the slope angle θ.

As shown in FIG. 2, the supply device 11 equips a backup plate 21 to move the paper sheets P toward the takeout side (carrying face 11*b*). The backup plate 21 is set to be storable into the support face 11*a* and movable along the support face. The backup plate 21 is supported to be rotatable for the support face 11*a*. Normally, for example, if the paper sheets P (the number of sheets is two thousands approximately) are carried in the supply device 11, the backup plate 21 is rotated at a position having almost same face as the support face 11*a*, and supported by a torsion spring and so on. When takeout of the paper sheets P is forwarded and the number of sheets decreases gradually (For example, the number of sheets is eight hundreds approximately), the backup plate 21 is rotated to a position to stand up at a right angle from the support face 11*a*. The backup plate 21 (rotated to the position to stand up) abuts a top shelf of the paper sheets P, and moves with the paper sheets P toward the takeout side. The backup plate 21 can make the paper sheets P move toward the takeout side. Even if the number of the paper sheets P is few, the backup plate 21 prevents falling of the paper sheets P. As a result, the paper sheets P can be stably moved to the takeout position.

As shown in FIG. 2, the takeout mechanism 14 to takeout the paper sheets P one by one from the supply device 11 includes a plurality of pickup roller 24, a separation roller 25, and a driving motor 26. The plurality of pickup roller 24 is set to be abutable against the paper sheets P on the carrying face 11*b*. The separation roller 25 is set to be rotationally connected to the pickup roller 24 at the side of the takeout pocket 11*e*. The driving motor 26 makes the pickup roller 24 rotate at a predetermined velocity.

By rotating of the pickup roller 24, the first paper sheet P positioned at a bottom shelf is taken out by the pickup roller 24, and transferred from the takeout pocket 11*e* to the transport path 16. By the separation roller 25, the paper sheets P (the second and subsequent sheets) are separated from the first paper sheet taken out. By the separation roller 25, the paper sheets P are taken out one by one from the supply device 11, and transferred to the transport path 16.

Based on the quantity of the paper sheets P carried or an input indication from the operator, the main controller 12 adjusts capturing quantity or capturing velocity of the paper sheets to the takeout mechanism 14 in plural steps. Namely, the main controller 12 adjusts a rotation velocity of the pickup roller 24 by the driving motor 26. For example, the main controller 12 sets the capturing quantity of one thousand, eight hundreds, and six hundreds per minute. Furthermore, based on detection status of a detection device 18 (explained afterwards), the main controller 12 adjusts the capturing quantity of the paper sheets P. For example, if the detection device 18 cannot execute detection of the paper sheets P favorably, the main controller 12 reduces the capturing quantity from one thousand per minute to eight hundreds per minute. Furthermore, when the detection device 18 detects double notes or short pitch of the paper sheets P, the main controller 12 makes the pickup roller 24 stop or reverse temporarily. By controlling the pickup roller 24, the main controller 12 prevents double notes of the paper sheets P, and normalizes feed pitch of the paper sheets P.

As shown in FIGS. 1 and 2, a transport pitch correction device 13 and the detection device 18 are located along the transport path 16. The transport pitch correction device 13 corrects a transport pitch of the paper sheets P transported by the transport path 16. The detection device 18 inspects the paper sheets P one by one after the transport pitch is corrected.

The detection device 18 is located upward from the takeout pocket 11*e* of the supply device 11 against the vertical direction. The detection device 18 inspects each of the paper sheets P, and detects denomination, shape, thickness, both sides, authenticity, fitness, double notes of the paper sheets P transported. Here, fitness-detection represents that fit notes to be recirculated and unfit notes (having dirt, break, and so on) not to be recirculated are detected.

The transport path 16 is extended downward from the takeout mechanism 14 and the takeout pocket 11*e* to one end, and extended upward from the one end to the detection device 18 with slope obliquely against the vertical direction. The transport path 16 is extended along the support face 11*a* of the supply device 11 approximately. Here, the transport path 16 may be extended upward obliquely from the takeout pocket 11*e* without extending downward from the takeout pocket 11*e*. The detection device 18 is set obliquely along the transport path 16.

By extending the transport path 16 from the lower side to the upper side obliquely, when foreign substances (such as clip, coin, pin) are captured with the paper sheets P from the supply device 11 to the transport path 16, the foreign substances fall into the lowest part of the transport path 16 along the transport path 16 by gravity. By excluding the foreign substances before entering into the detection device 18, damage of the detection device 18 by the foreign substances can be prevented.

As shown in FIG. 2, at the lowest part of the transport path 16, a reject pocket 28*a* is formed to a guide plate 28 to prescribe the transport path 16. At the down side of the reject pocket 28*a*, a foreign substance collection device is set. For example, the foreign substance collection box is composed as a collection box 27 able to be pulled out from the paper sheets processing apparatus 1. The foreign substances fallen along the transport path 16 are discharged from the reject pocket 28*a*, and collected into the collection box 27.

As shown in FIGS. 1 and 2, in the main module 10, two reject devices 20*a* and 20*b* are set along the transport path 16. Furthermore, a plurality of stackers 22*a*, 22*b*, 22*c* and 22*d* to stack the paper sheets P respectively is aligned. The paper sheets P passed through the detection device 18 are sorted (distributed) into reject notes and processed notes by gates (not shown in Figs.).

The reject notes represents, by the detection device 18, notes decided as counterfeit notes, or notes decided as undecidable notes due to bend, break, skew or double notes. The skew represents a status that the paper sheet P is positioned obliquely against a direction perpendicular to the transport direction. The reject notes are stacked by being sorting into the reject device 20*a* or the reject device 20*b*. As to the reject notes stacked into the reject device 20*a* or the reject device 20*b*, except for the counterfeit notes, they are recaptured by setting to the supply device 11 again, or counting data thereof is calculated manually. The detection result (such as an amount of money, the number of sheets) by the detection device 18 is sent to the main controller 12, preserved therein, and displayed on a monitor 15.

Furthermore, the processed note represents that the paper sheet P decided by the detection device 18 is a genuine note as a fit note, or a genuine note as an unfit note. The processed notes are transported to the stackers 22*a*~22*d* and stacked therein. For example, the processed notes are sorted (distributed) into any of stackers 22*a*~22*d* in correspondence with the denomination and stacked therein. Furthermore, the unfit notes are stacked into one stacker collectively.

The transport path 16 is connected to the storage module 30 (explained afterwards). When the paper sheets P are stored into the storage of the storage module 30, the processed notes detected by the detection device 18 of the main module 10 are sent to the storage module 30 via the transport path 16.

Here, the main module 10 equips a driving mechanism and a power supply (to drive the takeout mechanism 14, the detection device 18, the transport mechanism and so on), and various sensors (not shown in Figs.).

As shown in FIGS. 1 and 2, the storage module 30 includes an installation device 34, a storage-takeout mechanism 36, a detection device 38, a reject box 40, an alignment mechanism 42, and a transport path 44 to transport the paper sheets.

In the installation device 34, a storage 32 (such as an ATM cassette taken out from automatic transaction machine (ATM), a storage cassette and so on) is installed detachably. The storage-takeout mechanism 36 stores paper sheets into the storage 32, or takes out paper sheets from the storage 32.

On the transport path 44, a plurality of endless transport belts is extended so as to cramp the transport path. The paper sheets P are transported by held with the transport belt. The transport path 44 equips a first transport path 44*a* and a second transport path 44*b*. The first transport path 44*a* continues from the transport path 16 of the main module 10 to the strapping module 60*a*. The second transport path 44*b* passes from the first transport path 44*a*, adjacently via the installation device 34, the detection device 38 and the reject box 40, and returns to the first transport path 44*a*.

As the storage 32 installed into the installation device 34, a storage able to install (deposit of money) the paper sheets, a storage able to take out (withdrawal of money) the paper sheets, or a storage able to install and take out (deposit and withdrawal of money) the paper sheets, are used. Here, the storage 32 is composed able to install many paper sheets and take out therefrom.

The storage-takeout mechanism 36 includes a takeout roller to take out the paper sheets one by one from the storage 32, a storage roller to store the paper sheets into the storage 32, and a transport belt.

The detection device 38 inspects each of the paper sheets, and detects denomination, shape, thickness, both sides, authenticity, fitness, double notes, serial number of the paper sheets taken out from the storage 32. Here, fitness-detection represents that fit notes to be recirculated and unfit notes (having dirt, break, and so on) not to be recirculated are detected. The unfit notes include paper sheets on which a tape is put. As authenticity-detection, for example, magnetic-detection, image-detection, or fluorescence-detection to flash fluorescence and detect a reflected light therefrom, can be used.

The reject box 40 is set at the downstream side of the detection device 38 on the transport direction of the paper sheets. The paper sheets passed through the detection device 38 are sorted (distributed) into reject notes and processed notes by a gate (not shown in Fig.). The reject notes represents, by the detection device 38, notes decided as counterfeit notes, or notes decided as undecidable notes due to bend, break, skew or double notes. The reject notes are sent to the reject box 40 and stacked therein.

Furthermore, by previously setting at least one of storages 22*a*~22*d* of the main module 10 to the reject box, reject notes discharged from the storage module 30 may be sent to the reject box of the main module 10 and stacked therein. Further, among reject notes passed through the detection device 38, reject notes decided as counterfeit note and other reject notes may be separately stacked into respective reject boxes.

the processed note represents that the paper sheet P decided by the detection device 38 is a genuine note as a fit note, or a genuine note as an unfit note. The fit note is returned to the storage 32 via the second transport path 44*b* and the alignment mechanism 42, and stacked into the storage 32 by the takeout mechanism 36. By previously setting at least one of storages 22*a*~22*d* of the main module 10 to an unfit note box, unfit notes discharged from the storage module 30 may be sent to the unfit note box of the main module 10 and stacked therein.

The fit notes taken out from the storage 32 may be stacked into the storages 22*a*~22*d* of the main module 10 by the arbitrary indicated number of sheets (previously set for each denomination). Furthermore, if the number of sheets (For example, two thousands) to be stacked into the storage 32, the main controller 12 can recognize a deficient number of sheets from the number of sheets of fit notes detected by the detection device 38. After recognizing the deficient number, the main controller 12 supplies paper sheets P of the deficient number from the main module 10 to the storage module 30, and stores them into the storage 32 via the alignment mechanism 42 and the transport path 44.

After the storage 32 is installed into the installation device 34 of the storage module 30, the sub controller 31 sends an amount in hand of paper sheets P (stored in the storage 32) to the main controller 12. If the main controller 12 decides that the amount in hand is smaller than a desired amount in hand, the main controller 12 may supply paper sheets of deficiency from the main module 10 to the storage 32 and stores the paper sheets into the storage 32.

The strapping module 60*a* straps the predetermined number of paper sheets P with a strap band. As shown in FIGS. 1 and 2, the strapping module 60*a* includes a transport path 62, a stack device 75*a*, a sensor S1, a strap belt supply device 76*a*, a display 77*a*, and an imaging device 78*a*.

The transport path 62 connects to the first transport path 44*a* of the storage module 30. The stack device 75*a* stacks the paper sheets sent via the transport path 62. The sensor S1 detects the paper sheets discharged to the stack device 75*a*.

The strap band supply device 76*a* supplies a strap band to strap a bundle of paper sheets P stacked in the stack device 75*a*. The strap band supply device 76*a* supplies a strap band formed as a reel shape (strap band reel). For example, the strap band supply device 76*a* stores two strap band reels (A side-strap band reel and B side-strap band reel) into a storage formed therein. Here, the strap band supply device 76*a* stores two strap band reels in parallel so as to commonly have one rotation angle.

The strap band supply device 76*a* supplies a strap band using one of two strap band reels. For example, the strap band supply device 76*a* pulls a strap band from A side-strap band reel, cuts the strap band by a predetermined length, and supplies the strap band of the predetermined length. Here, a strap band reel (For example, A side) to be supplied is a main side-strap band reel (first strap band reel), and the other one (For example, B side) is a secondary side-strap band reel (second strap band reel).

When the strap band supply device 76*a* detects shortage of remaining quantity of the main side-strap band reel, the strap band supply device 76*a* supplies new strap band using the secondary side-strap band reel.

Furthermore, when the strap band supply device 76*a* detects shortage of remaining quantity of the secondary side-strap band reel, the strap band supply device 76*a* switches the secondary side-strap band reel to the main side-strap band reel. For example, if A side-strap band reel is the main side-strap band reel and if B side-strap band reel is the secondary side-strap band reel, by above-mentioned switching, the strap band supply device 76*a* sets B side-strap band reel to the main side-strap band reel, and sets A side-strap band reel to the secondary side-strap band reel.

Based on a signal from the sub controller 61*a*, the strap band supply device 76*a* supplies a strap band from the main side-strap band reel. Furthermore, based on a signal from the sub controller 61*a*, the strap band supply device 76*a* can switch the secondary side-strap band reel to the main side-strap band reel. The display 77*a* guides that the predetermined number of paper sheets are stacked in the stack device 75*a*.

The imaging device 78*a* images a strap band reel (stored in the strap band supply device 76*a*) with color. For example, the imaging device 78*a* is located in the storage of the strap band supply device 76*a*. The imaging device 78*a* images two strap band reels stored in the storage. The imaging device 78*a* sends an image (strap band image) to the sub controller 61*a*. For example, the imaging device 78*a* is CCD camera.

As shown in FIG. 1, another strapping module 60*b* has the same component as the strapping module 60*a*. Respective transport paths 62 of the strapping modules 60*a* and 60*b* are connectively extended each other. The paper sheets P from the main module 10 or the storage module 30 are sent to the strapping module 60*a* or the strapping module 60*b*, and stacked therein.

At the downmost-stream of all modules, a safety box 74 is set. If there is paper sheets not processed during being transported in each module, the paper sheets P are discharged to the safety box 74, and saved from the paper sheets processing apparatus 1.

Figures 4, 5:
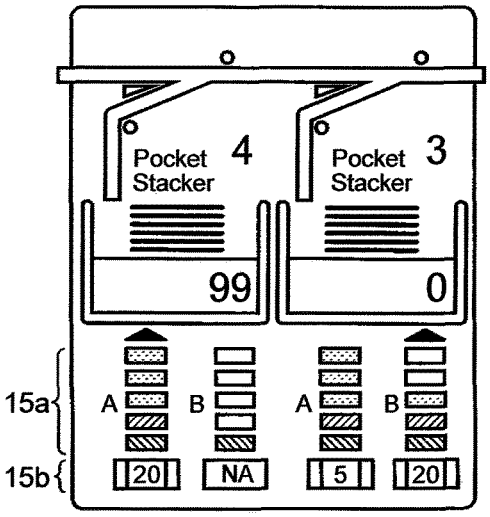
FIG. 4 is one example of component of a strap band color table according to one embodiment.
FIG. 5 is one example of a screen of a display according to one embodiment.

Next, a strap band color table stored in the memory 12*b* will be explained. FIG. 4 is a component example of the strap band color table. As shown in FIG. 4, the strap band color table stores "banknote", "the number of sheets" and "color" correspondingly. Here, "banknote" represents denomination of banknotes strapped by the strapping module 60*a* and 60*b*. In FIG. 4, "banknote" is dollar bill. Namely, "banknote" is one-dollar bill, two-dollar bill, . . . , one hundred-dollar bill. Further, "banknote" may be another currency bill such as yen, ruble, euro, and so on.

In FIG. 4, "the number of sheets" represents the number of paper sheets to be strapped by the strapping modules 60*a* and 60*b*. Here, "the number of sheets" is fifty or one hundred. Further, "the number of sheets" is not limited to a predetermined numerical value.

In FIG. 4, "color" represents strap band color. Namely, "color" represents a strap band color used for strapping "banknote" with "the number of sheets" by strapping modules 60*a* and 60*b*. For example, when fifty sheets of one-dollar bill are strapped, the strapping modules 60*a* and 60*b* use a pink-strap band.

The strap band color table may prepare "color" corresponding to paper sheets except for "banknote". Furthermore, the strap band color table may prepare "color" corresponding to a plurality of currency bills.

Furthermore, the strap band color table may not prepare "the number of sheets". If the strap band color table does not prepare "the number of sheets" (i.e., the strap band color is not changed by the number of sheets), irrespective of the number of sheets to be strapped, the strapping modules 60*a* and 60*b* strap banknotes (the predetermined number of banknotes) with a strap band of color corresponding to "banknote".

The strap band color table is previously stored in the memory 12*b*. For example, the main controller 12 accepts an input of data to generate the strap band color table from the operator via the operation device 17. The main controller 12 generates the strap band color table based on the input data, and stores the strap band color table into the memory 12*b*. Furthermore, the main controller 12 updates the strap band color table based on an operation inputted to the operation device 17.

Next, a function realized by the main controller 12 will be explained. The main controller 12 has a function (setting device) to set the denomination and the number of sheets of banknotes to be strapped to the strapping modules 60*a* and 60*b*. For example, the main controller 12 accepts an input of the denomination and the number of sheets of banknotes to be strapped (i.e., banknotes to be set into the supply device 11) via the operation device 17. The main controller 12 sends strapping information (inputted) representing the denomination and the number of sheets of banknotes to the strapping modules 60*a* and 60*b*.

Furthermore, the main controller 12 has a function (determination device) to set a strap band color used for strapping to the strapping modules 60*a* and 60*b*. The main controller 12 determines the strap band color based on the denomination and the number of sheets of banknotes (inputted). For example, the main controller 12 determines a color corresponding to the denomination and the number of sheets of banknotes by referring to the strap band color table. The main controller 12 sends color information representing the color (determined) to the strapping modules 60*a* and 60*b*.

Furthermore, the main controller 12 has a function to receive strap band information representing status of the strap band reel (stored in the strap band supply device 76*a*) from the strapping modules 60*a* and 60*b*, and present the strap band information. The strap band information represents whether the strap band reel is loaded or not. For example, the strap band information represents that at least one strap band reel is loaded or no strap band reels are loaded.

Furthermore, the strap band information represents a color of the strap band reel loaded. For example, the strap band information represents a color of the main side-strap band reel and a color of the secondary-side strap band reel respectively.

Furthermore, the strap band information represents a remaining quantity of the strap band reel. For example, as the remaining quantity of the strap band reel, the strap band information represents any of "Full", "¾", "½", "¼" and "Low". "Full" represents that the strap band reel is almost unused. "¾" represents that ¾ of the strap band reel is remained. "½" represents that ½ of the strap band reel is remained. "¼" represents that ¼ of the strap band reel is remained. "Low" represents that the remaining quantity of the strap band reel is a little (near-end). Here, "Low" is the remaining quantity able to strap the paper sheets at least one time. Furthermore, the remaining quantity (smaller than "Low") unable to strap the paper sheets, i.e., a status that the remaining quantity of the strap band reel is zero (or extremely a little) is defined as "shortage of remaining quantity". The strap band information represents a remaining quantity of the main side-strap band reel and a remaining quantity of the secondary side-strap band reel respectively.

For example, based on the strap band information, the main controller 12 presents a color of the main side-strap band reel and a color of the secondary side-strap band reel (color presentation device). For example, the main controller 12 displays the color of the main side-strap band reel and the color of the secondary side-strap band reel on the monitor 15.

Furthermore, based on the strap band information, the main controller 12 presents a remaining quantity of the main side-strap band reel and a remaining quantity of the secondary side-strap band reel (remaining quantity presentation device). For example, the main controller 12 displays the color of the main side-strap band reel and the color of the secondary side-strap band reel on the monitor 15.

FIG. 5 shows a display example of the monitor 15 to display the strap band information. Here, stackers 3 and 4 correspond to strapping modules 60*a* and 60*b* respectively.

As shown in FIG. 5, the main controller 12 sets display regions 15*a* and 15*b* on the monitor 15.

A display region 15*a* shows the remaining quantity or existence/non-existence of the strap band reel. For example, in FIG. 5, the display region 15*a* shows that an unused strap band reel is set to A side (secondary side) of the stacker 3 and a strap band reel of which one half is remained is set to B side (main side) of the stacker 3. Furthermore, the display region 15*a* shows that an unused strap band reel is set to A side (main side) of the stacker 4 and a strap band reel is not set to B side (secondary side) of the stacker 4.

Furthermore, a display region 15*b* shows a denomination of banknote corresponding to the color of strap band reel. For example, in FIG. 15, the display region 15*b* shows that a strap band reel having a color to strap five dollars is set to A side of the stacker 3 and a strap band reel having a color to strap twenty dollars is set to B side of the stacker 3. Furthermore, the display region 15*b* shows that a strap band reel having a color to strap twenty dollars is set to A side of the stacker 4. Here, the display region 15*b* may display the number of sheets to be strapped. Components of the display regions 15*a* and 15*b* are not limited to specific component.

Furthermore, the main controller 12 has a function to receive warning information from the strapping modules 60*a* and 60*b*, and a function to present a warning related to the color of the strap band reel based on the warning information (warning presentation device). For example, the warning information represents that there are no strap band reels having a color shown by the color information, or remaining quantity of the strap band reel having a color shown by the color information is a little (near-end).

When the main controller 12 receives the warning information, the main controller 12 display a warning on the monitor 15 based on the warning information. For example, if the warning information represents that there are no strap band reels having a color shown by the color information, the main controller 12 displays a message to urge to exchange the main side-strap band reel and the secondary side-strap band reel. Furthermore, if the warning information represents that the remaining quantity of the strap band reel having a color shown by the color information is a little (near-end), the main controller 12 displays a message to urge to exchange the secondary side-strap band reel.

Next, a function realized by the sub controller 61*a* of the strapping module 60*a* will be explained. The sub controller 61*a* has a function to acquire a strap band image captured by the imaging device 78*a* (acquisition device). For example, the sub controller 61*a* sends a signal to make the imaging device 78*a* capture an image to the imaging device 78*a*. The sub controller 78*a* receives a strap band image from the imaging device 78*a*.

The sub controller 61*a* has a function to decide a color of the strap band reel based on the strap band image (color decision device). Namely, the sub controller 61*a* decides a color of A side-strap band reel and a color of B side-strap band reel. For example, the sub controller 61*a* decides the color of the strap band reel as follows.

Figure 6:
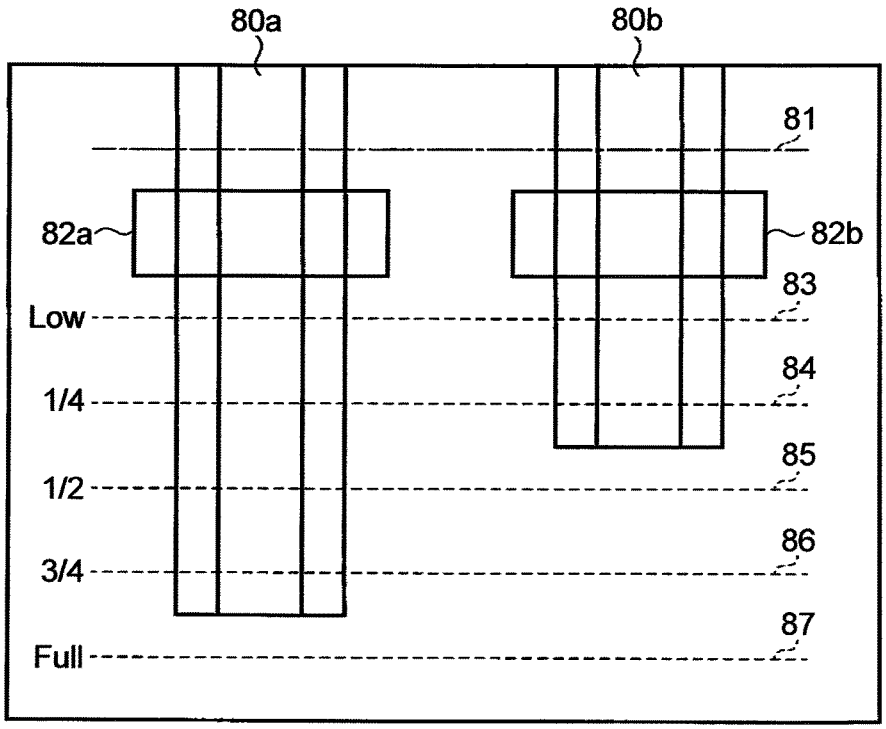
FIG. 6 is one example of a strap band image according to one embodiment.

FIG. 6 shows one example of a strap band image. This example is the strap band image which a strap band reel 80*a* (A side-strap band reel) and a strap band reel 80*b* (B side-strap band reel) are imaged. The strap band image shown in FIG. 6 is an image captured from a direction perpendicular to a rotation axis of the strap band reel.

In FIG. 6, a line 81 represents the rotation axis of the strap band reels 80*a* and 80*b*. As shown in FIG. 6, the sub controller 61*a* sets a decision area 82 into the strap band image. The decision area 82 includes at least one part of the strap band reel 80. Here, the decision area 82*a* includes the strap band reel 80*a*. Furthermore, the decision area 82*b* includes the strap band reel 80*b*.

The sub controller 61*a* decides a color of the decision area 82, and decides a color of the strap band reel 80. For example, the sub controller 61*a* decides a color of the decision area 82*a*, and decides a color of the strap band reel 80*a*. Furthermore, the sub controller 61*a* decides a color of the decision area 82*b*, and decides a color of the strap band reel 80*b*.

Furthermore, the sub controller 61*a* has a function to decide a remaining quantity of the strap band reel 80 based on the strap band image (remaining quantity decision device). Namely, the sub controller 61*a* decides respective remaining quantities of the strap band reels 80*a* and 80*b*. For example, the sub controller 61*a* decides a remaining quantity of the strap band reel as follows.

As shown in FIG. 6, the sub controller 61*a* sets thresholds (lines) 83~87 into the strap band image. A threshold 83 is a boundary to decide that the remaining quantity is "Low". A threshold 84 is a boundary to decide that the remaining quantity is "¼". A threshold 85 is a boundary to decide that the remaining quantity is "½". A threshold 86 is a boundary to decide that the remaining quantity is "¾". A threshold 87 is a boundary to decide that the remaining quantity is "Full". In the same way, "shortage of remaining quantity" less than "Low" can be decided (not shown in FIG. 6).

For example, if a tip of the strap band reel 80 is positioned between thresholds 86 and 87, the sub controller 61*a* decides that the remaining quantity of the strap band reel 80 is "Full". Furthermore, if the tip of the strap band reel 80 is positioned between thresholds 85 and 86, the sub controller 61*a* decides that the remaining quantity of the strap band reel 80 is "¾". Furthermore, if the tip of the strap band reel 80 is positioned between thresholds 84 and 85, the sub controller 61*a* decides that the remaining quantity of the strap band reel 80 is "½". Furthermore, if the tip of the strap band reel 80 is positioned between thresholds 83 and 84, the sub controller 61*a* decides that the remaining quantity of the strap band reel 80 is "¼". Furthermore, if the tip of the strap band reel 80 does not reach the threshold 83, the sub controller 61*a* decides that the remaining quantity of the strap band reel 80 is "Low". Furthermore, if the tip of the strap band reel 80 does not reach the threshold to decide "shortage of remaining quantity", the sub controller 61*a* decides that the remaining quantity of the strap band reel 80 is "shortage of remaining quantity". Alternatively, if the tip of the strap band reel 80 is separated at a predetermined distance from the threshold 83 toward the strap band reel, the sub controller 61*a* decides that the remaining quantity of the strap band reel 80 is "shortage of remaining quantity". Alternatively, if strapping processing is performed the predetermined number of times after deciding "Low", the sub controller 61*a* decides that the remaining quantity of the strap band reel 80 is "shortage of remaining quantity".

Furthermore, the sub controller 61*a* has a function to send strap band information (representing a color and a remaining quantity of the strap band reel 80) to the main controller 12. Namely, the sub controller 61*a* sends strap band information (representing a color and a remaining quantity of the strap band reels 80*a* and 80*b*) to the main controller 12.

Furthermore, the sub controller 61*a* has a function to compare a color represented by the color information with a color of the strap band reel 80. The sub controller 61*a* compares the color represented by the color information with a color of the strap band reel 80*a*. Furthermore, the sub controller 61*a* compares the color represented by the color information with a color of the strap band reel 80*b*.

Furthermore, based on the comparison result of the color represented by the color information and the color of the strap band reel 80, the sub controller 61*a* sends warning information to the main controller 12. For example, if respective colors of the strap band reels 80*a* and 80*b* are different from the color of the color information, the sub controller 61*a* sends warning information (representing that there are no strap band reels having the color of the color information) to the main controller 12.

Furthermore, if a color of the secondary side-strap band reel is different from the color of the color information, when the remaining quantity of the main side-strap band reel (having the color of the color information) is "Low" (lower than a predetermined quantity), the sub controller 61*a* sends warning information (representing that the remaining quantity of the strap band reel having the color of the color information is a little (near-end)) to the main controller 12.

For example, assume that the strap band reel 80*a* is the main side-strap band reel and the strap band reel 80*b* is the secondary side-strap band reel. Furthermore, a color of the strap band reel 80*a* is same as the color of the color information. Furthermore, a color of the strap band reel 80*b* is different from the color of the color information.

The sub controller 61*a* decides whether a remaining quantity of the strap band reel 80*a* is "Low". If the remaining quantity of the strap band reel 80*a* is "Low", the sub controller 61*a* sends warning information (representing the remaining quantity of the strap band reel having the color of the color information is a little (near-end)) to the main controller 12.

Further, a function realized by the sub controller 61*b* of the strapping module 60*b* is same as the function of the sub controller 61*a*. Accordingly, explanation of the function of the sub controller 61*b* is omitted.

Figure 7:
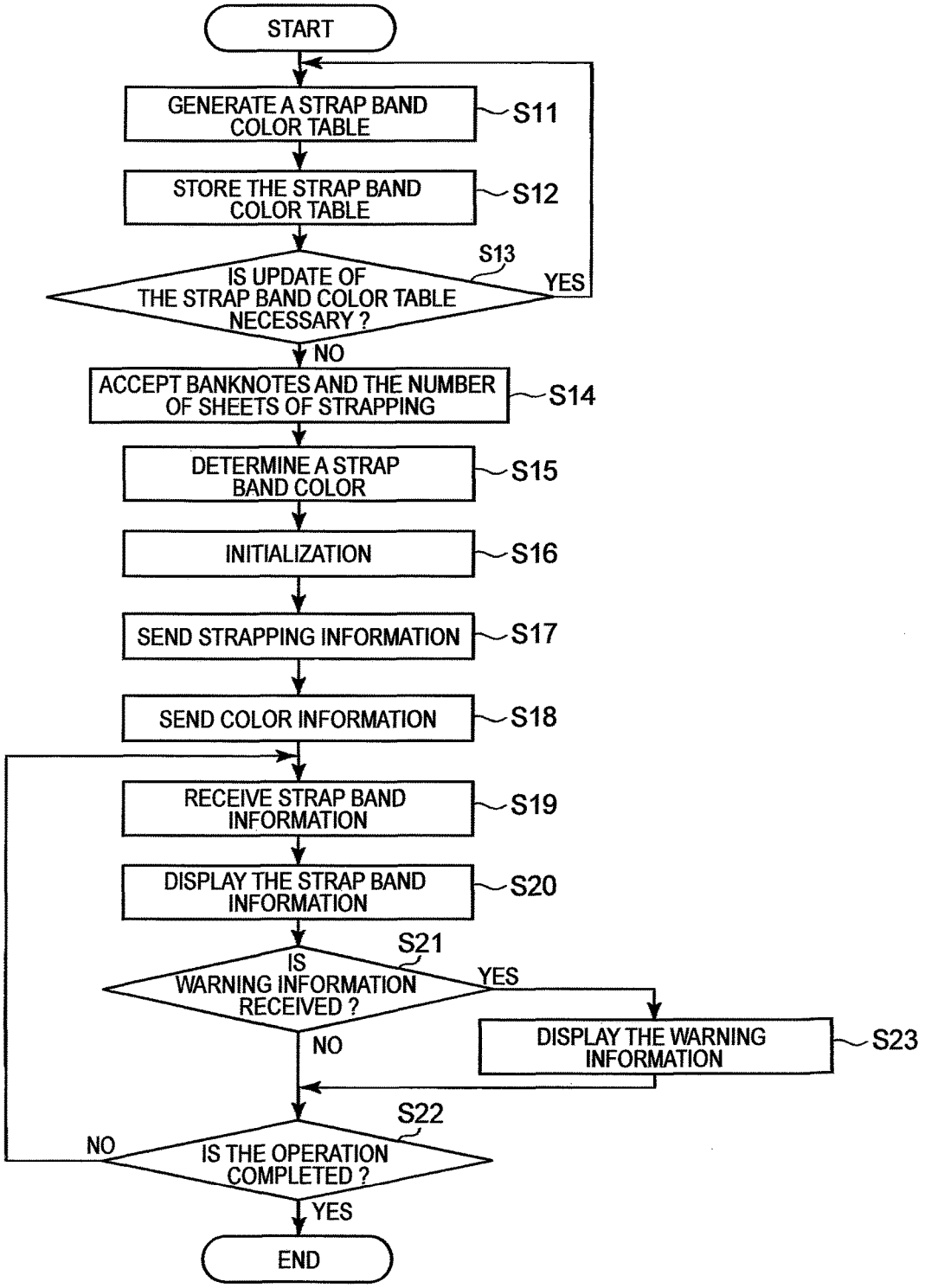
FIG. 7 is a flow chart to explain an operation example of a main controller according to one embodiment.

Next, an operation example of the main controller 12 will be explained. FIG. 7 shows a flow chart to explain the operation example of the main controller 12.

Here, the main controller 12 supplies banknotes (paper sheets P) to the strapping modules 60*a* and 60*b* to strap them.

First, the main controller 12 generates a strap band color table based on an input from the operation device 17 (S11). After generating the strap band color table, the main controller 12 stores the strap band color table into the memory 12*b* (S12).

After storing the strap band color table into the memory 12*b*, the main controller 12 decides whether update of the strap band color table is necessary (S13). If update of the strap band color table is necessary (Yes at S13), processing of the main controller 12 is returned to S11.

If update of the strap band color table is not necessary (No at S13), the main controller 12 accepts an input of denomination of banknotes (to be strapped) and the number of sheets (of strapping) via the operation device 17 (S14). After accepting the input of denomination of banknotes and the number of sheets, the main controller 12 determines a strap band color by referring to the strap band color table (S15).

After determining the strap band color, the main controller 12 initializes the paper sheets processing apparatus 1 (S16). For example, the main controller 12 resets the paper sheets processing apparatus 1, and performs a predetermine setting thereto.

After initializing the paper sheets processing apparatus 1, the main controller 12 sends strapping information (representing the denomination of banknotes and the number of sheets (accepted at S14)) to the strapping modules 60*a* and 60*b* (S17). After sending the strapping information to the strapping modules 60*a* and 60*b*, the main controller 12 sends color information (representing the color determined at S15) to the strapping modules 60*a* and 60*b* (S18).

After sending the color information to the strapping modules 60*a* and 60*b*, the main controller 12 receives strap band information from the strapping modules 60*a* and 60*b* (S19). Here, the main controller 12 waits from sending of the color information to receiving of the strap band information.

After receiving the strap band information, the main controller 12 displays the strap band information via the monitor 15 (S20). After displaying the strap band information on the monitor 15, the main controller 12 decides whether warning information is received from the strapping module 60*a* or 60*b* (S21).

If the warning information is not received (No at S21), the main controller 12 decides whether the operation (business) is completed (S22). For example, when the main controller 12 detects that processing of banknotes set onto the supply device 11 is completed or an indication to complete the job is inputted via the operation device 17, the main controller 12 decides that the operation (business) is completed.

If the operation (business) is not completed (No at S22), processing of the main controller 12 is returned to S19. If the operation (business) is completed (Yes at S22), the main controller 12 completes the processing.

If the main controller 12 decides that the warning information is received (Yes at S21), the main controller 12 displays a warning via the monitor 15 based on the warning information (S23).

After displaying the warning, processing of the main controller 12 is forwarded to S22.

Figure 8:
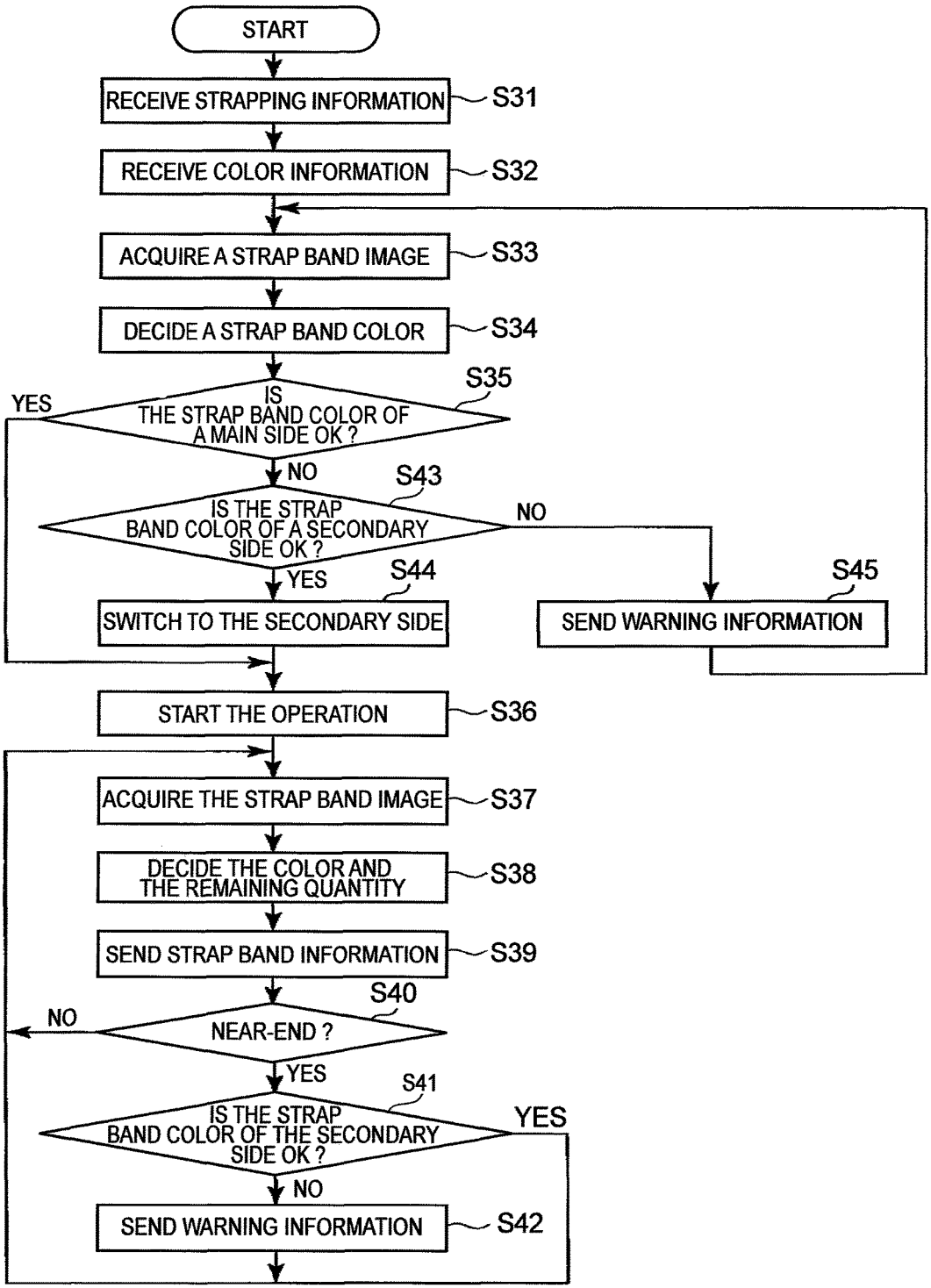
FIG. 8 is a flow chart to explain an operation example of a sub controller according to one embodiment.

Next, an operation example of the sub controller 61*a* will be explained. FIG. 8 shows a flow chart to explain the operation example of the sub controller 61*a*. First, the sub controller 61*a* receives the strapping information from the main controller 12 (S31). After receiving the strapping information, the sub controller 61*a* receives the color information from the main controller 12 (S32). After receiving the color information, the sub controller 61*a* acquires a strap band image from the imaging device 78*a* (S33).

After acquiring the strap band image, the sub controller 61*a* decides a color of the strap band reel (strap band color) based on the strap band image (S34). After deciding the color of the strap band reel, the sub controller 61*a* decides whether a color of the main side-strap band reel is same as the color of the color information (S35).

If the color of the main side-strap band reel is same as the color of the color information (Yes at S35), the sub controller 61*a* starts a strapping operation (S36). After starting the strapping operation, the sub controller 61*a* acquires the strap band image from the imaging device 78*a* (S37).

After acquiring the strap band image, the sub controller 61*a* decides a color and a remaining quantity of the strap band reel (S38). After deciding the color and the remaining quantity of the strap band reel, the sub controller 61*a* sends strap band information (representing the color and the remaining quantity decided) to the main controller 12 (S39).

After sending the strap band information to the main controller 12, the sub controller 61*a* decides whether the remaining quantity of the main side-strap band reel is "Low" (near-end) (S40). If the remaining quantity of the main side-strap band reel is not "Low" (near-end) (No at S40), processing of the sub controller 61*a* is returned to S37.

If the remaining quantity of the main side-strap band reel is "Low" (near-end) (Yes at S40), the sub controller 61*a* decides whether a color of the secondary side-strap band reel is same as the color of the color information (S41).

If the color of the secondary side-strap band reel is same as the color of the color information (Yes at S41), processing of the sub controller 61*a* is returned to S37. If the color of the secondary side-strap band reel is not same as the color of the color information (In other words, if the color of the secondary side-strap band reel is different from the color of the color information) (No at S41), the sub controller 61*a* sends warning information (representing that the remaining quantity of the strap band reel having the color of the color information is a little (near-end)) to the main controller 12 (S42). After sending the warning information to the main controller 12, processing of the sub controller 61*a* is returned to S37.

If the color of the main side-strap band reel is not same as the color of the color information (No at S35), the sub controller 61*a* decides whether the color of the secondary side-strap band reel is same as the color of the color information (S43). If the color of the secondary side-strap band reel is same as the color of the color information (Yes at S43), the sub controller 61*a* switches (changes) from the main side-strap band reel to the secondary side-strap band reel (i.e., the secondary side-strap band reel is selected as a new main side-strap band reel) (S44). After switching to the secondary side-strap band reel as the new main side-strap band reel, processing of the sub controller 61*a* is forwarded to S36.

If the color of the secondary side-strap band reel is not same as the color of the color information (No at S43), the sub controller 61*a* sends warning information (representing that there are no strap band reels having the color of the color information) to the main controller 12 (S45). After sending the warning information to the main controller 12, processing of the sub controller 61*a* is returned to S33. The operation of the sub controller 61*b* is same as the operation of the sub controller 61*a*. Accordingly, explanation of the operation of the sub controller 61*b* is omitted.

Further, the function executed by the sub controller 61*a* may be executed by the main controller 12. Conversely, the function executed by the main controller 12 may be executed by the sub controller 61*a*. For example, the main controller 12 may decide whether the color of the strap band reel is same as a color determined as the strap band color of strapping, based on the strap band information. Furthermore, the main controller 12 may display various warnings via the monitor 15, based on the decision result.

Furthermore, the main controller 12 may automatically decide a denomination of banknotes by using a sensor and so on. For example, the main controller 12 may determine the color of strap band reel, based on the denomination (decided) of banknotes.

Furthermore, if the color of the secondary side-strap band reel is different from the color of the color information, the sub controller 61*a* may stop the operation, based on the decision result representing shortage of remaining quantity of the main side-strap band reel having the color of the color information.

As mentioned-above, in the paper sheets processing apparatus, a color of a strap band reel to be used for strapping is determined. Furthermore, based on an image of a strap band reel already loaded, a color of the strap band reel is decided. As a result, if the color determined is not same as the color of the strap band reel already loaded, the warning can be presented.

Furthermore, in the paper sheets processing apparatus, a remaining quantity of the strap band reel already loaded is decided. As a result, if the remaining quantity of the main side-strap band reel is a little and if a color of the secondary side-strap band reel is not same as the color determined, the warning can be presented.

While certain embodiments have been described, these embodiments have been presented by way of examples only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A strapping apparatus comprising:

a main controller that sets a denomination of paper sheets to be strapped, and determines a color of a strap band to strap a bundle of the paper sheets, based on the denomination;

a strap band supply device that stores a first strap band reel having strap bands to be supplied;

an imaging device that acquires an image of the first strap band reel;

a sub-controller that decides a color of the first strap band reel, based on the image; wherein the main controller presents a warning via a monitor if the color of the first strap band reel is different from the color determined by the main controller; wherein the sub-controller decides a remaining quantity of the first strap band reel, based on the image, the strap band supply device further stores a second strap band reel, the sub-controller makes the strap band supply device supply strap bands from the second strap band reel if the remaining quantity of the first strap band reel is less than a predetermined remaining quantity, and the main controller presents the warning via the monitor if a color of the second strap band reel is different from the color determined by the main controller and if the remaining quantity of the first strap band reel is less than the predetermined remaining quantity.

2. The strapping apparatus according to claim 1, wherein the sub-controller makes the strap band supply device supply strap bands from the second strap band reel if the color of the first strap band reel is different from the color determined by the main controller and if the color of the second strap band reel is same as the color determined by the main controller.

3. The strapping apparatus according to claim 1, wherein the sub-controller decides a remaining quantity of the second strap band reel, based on the image, and the monitor presents the remaining quantity of the first strap band reel and the remaining quantity of the second strap band reel.

4. The strapping apparatus according to claim 1, wherein the sub-controller sets a decision area onto the image, and decides the color of the first strap band reel, based on a color in the decision area.

5. The strapping apparatus according to claim 1, wherein the monitor presents the color of the first strap band reel.

6. The strapping apparatus according to claim 1, wherein the paper sheets are banknotes.

7. The strapping apparatus according to claim 1, wherein the main controller sets the number of sheets to be strapped among the paper sheets, and determines the color of the strap band to strap the bundle of the paper sheets, based on the number of sheets.

8. A paper sheets processing apparatus comprising:

a detection device that detects processed notes and rejected notes from paper sheets by inspecting each of the paper sheets;

a stack device that stacks the processed notes;

a main controller sets a denomination of the processed notes to be strapped, and determines a color of a strap band to strap a bundle of the processed notes, based on the denomination;

a strap band supply device that stores a first strap band reel having strap bands to be supplied;

an imaging device that acquires an image of the first strap band reel;

a sub-controller that decides a color of the first strap band reel, based on the image; wherein the main controller presents a warning via a monitor if the color of the first strap band reel is different from the color determined by the main controller; wherein the sub-controller decides a remaining quantity of the first strap band reel, based on the image, the strap band supply device further stores a second strap band reel, the sub-controller makes the strap band supply device supply strap bands from the second strap band reel if the remaining quantity of the first strap band reel is less than a predetermined remaining quantity, and the main controller presents the warning via the monitor if a color of the second strap band reel is different from the color determined by the main controller and if the remaining quantity of the first strap band reel is less than the predetermined remaining quantity.

9. The paper sheets processing apparatus according to claim 8, wherein the sub-controller makes the strap band supply device supply strap bands from the second strap band reel if the color of the first strap band reel is different from the color determined by the main controller and if the color of the second strap band reel is same as the color determined by the main controller.

10. The paper sheets processing apparatus according to claim 8, wherein the sub-controller decides a remaining quantity of the second strap band reel, based on the image, and the monitor presents the remaining quantity of the first strap band reel and the remaining quantity of the second strap band reel.

11. The paper sheets processing apparatus according to claim 8, wherein the sub-controller sets a decision area onto the image, and decides the color of the first strap band reel, based on a color in the decision area.

12. The paper sheets processing apparatus according to claim 8, wherein the monitor presents the color of the first strap band reel.

13. The paper sheets processing apparatus according to claim 8, wherein the paper sheets are banknotes.

14. The paper sheets processing apparatus according to claim 8, wherein the main controller sets the number of sheets to be strapped among the processed notes, and determines the color of the strap band to strap the bundle of the processed notes, based on the number of sheets.

15. The paper sheets processing apparatus according to claim 14, further comprising:

a strap band color table that stores the denomination of paper sheets, the number of sheets to be strapped, and the color of the strap band to strap the number of sheets, correspondingly;

wherein the main controller determines the color of the strap band to strap the bundle of the processed notes, based on the strap band color table, and the color of the strap band is corresponded with the denomination of the processed notes, and the number of sheets set by the main controller, in the strap band color table.

16. The paper sheets processing apparatus according to claim 8, wherein the sub-controller makes the strap band supply device start a strapping operation by supplying strap bands from the first strap band reel if the color of the first strap band reel is same as the color determined by the main controller, and decides a remaining quantity of the first strap band reel, based on the image of the first strap band reel acquired during the strapping operation.

17. The paper sheets processing apparatus according to claim 9, wherein, after the sub-controller makes the strap band supply device start a strapping operation by supplying strap bands from the second strap band reel, the sub-controller decides a remaining quantity of the second strap band reel, based on the image of the second strap band reel acquired during the strapping operation.

* * * * *